US010125778B1

(12) United States Patent
Harris

(10) Patent No.: US 10,125,778 B1
(45) Date of Patent: Nov. 13, 2018

(54) SMOKE DEFLECTOR HAVING A FAN FOR PURGING A SMOKE DETECTOR

(71) Applicant: James E. Harris, Miami Shores, FL (US)

(72) Inventor: James E. Harris, Miami Shores, FL (US)

( * ) Notice: Subject to any disclaimer, the term of this patent is extended or adjusted under 35 U.S.C. 154(b) by 273 days.

(21) Appl. No.: 14/934,296

(22) Filed: Nov. 6, 2015

Related U.S. Application Data

(60) Provisional application No. 62/087,488, filed on Dec. 4, 2014.

(51) Int. Cl.

| | |
|---|---|
| ***F04D 25/08*** | (2006.01) |
| ***F04D 29/60*** | (2006.01) |
| ***F04D 25/06*** | (2006.01) |
| ***F04D 29/00*** | (2006.01) |
| ***F04D 29/40*** | (2006.01) |
| ***F24C 15/20*** | (2006.01) |

(52) U.S. Cl.
CPC ..... *F04D 25/084* (2013.01); *F04D 25/0673* (2013.01); *F04D 29/002* (2013.01); *F04D 29/403* (2013.01); *F04D 29/601* (2013.01); *F24C 15/2092* (2013.01)

(58) Field of Classification Search
CPC .... F04D 19/00; F04D 25/0673; F04D 25/084; F04D 25/086; F04D 29/002; F04D 29/403; F24C 15/2092; F24C 15/2007
See application file for complete search history.

(56) References Cited

U.S. PATENT DOCUMENTS

| | | | | |
|---|---|---|---|---|
| 1,314,314 A * | 8/1919 | Fischbein et al. | .... | F04D 25/086 416/69 |
| 2,759,714 A * | 8/1956 | Ayup | ..... | F04D 25/08 261/100 |
| 3,518,776 A * | 7/1970 | Wolff | ..... | A45D 20/08 34/202 |
| 3,558,243 A * | 1/1971 | Trapp | ..... | F04B 17/00 417/411 |
| 4,617,560 A * | 10/1986 | Gutmann | ..... | G08B 17/10 340/628 |
| 5,411,372 A | 5/1995 | Clark | | |
| 5,558,501 A | 9/1996 | Wang et al. | | |
| 5,791,763 A * | 8/1998 | Kam-Hoi | ..... | F04D 25/08 320/115 |
| 6,017,188 A | 1/2000 | Benton | | |
| 6,027,309 A | 2/2000 | Rawls et al. | | |
| 6,055,680 A * | 5/2000 | Tolbert | ..... | E03C 1/308 4/255.11 |
| 8,205,478 B1 * | 6/2012 | Hallisey | ..... | G08B 29/145 340/515 |

(Continued)

*Primary Examiner* — Bryan Lettman
*Assistant Examiner* — Timothy P Solak
(74) *Attorney, Agent, or Firm* — Allen Dyer Doppelt & Gilchrist, PA

(57) ABSTRACT

A smoke deflector includes a pole, a handle on a first end of the pole, and a fan assembly mounted on a second end of the pole opposite the handle. A method for using a smoke deflector to blow smoke away from a smoke detector includes the steps of holding the smoke deflector by the handle, adjusting the pole of the smoke deflector to set a desired length, adjusting the fan assembly of the smoke deflector to a desired angle, positioning the fan assembly adjacent to the smoke detector, and turning on the smoke deflector.

3 Claims, 3 Drawing Sheets

(56) References Cited

U.S. PATENT DOCUMENTS

| | | | | |
|---|---|---|---|---|
| D676,535 | S * | 2/2013 | Barrett | D23/328 |
| 2002/0121296 | A1 | 9/2002 | Copple | |
| 2003/0227389 | A1 * | 12/2003 | McGreal | G08B 17/10 340/628 |
| 2010/0272569 | A1 | 10/2010 | Benton | |

* cited by examiner

SMOKE DEFLECTOR HAVING A FAN FOR PURGING A SMOKE DETECTOR

CROSS-REFERENCE TO RELATED APPLICATION

This application claims the benefit of U.S. Provisional Patent Application Ser. No. 62/087,488, filed on Dec. 4, 2014, the contents of which application are herein incorporated by reference in their entirety.

FIELD OF THE INVENTION

The present invention relates to smoke deflectors, and more particularly, to smoke deflectors used to direct smoke away from smoke detectors.

BACKGROUND OF THE INVENTION

A smoke detector or smoke alarm is usually mounted on the ceiling of a room or structure. The device will be programmed to sound off and alert occupants to the detection of excessive smoke. Smoke detectors can, however, signal a false positive; that is, sound off when there is no danger of fire. For example, some smoke detectors sound off when a harmless activity in the kitchen of a home or apartment produces a large amount of smoke. Although most smoke detectors can be silenced by complete disarming or deactivation, further developments could improve the ability to reduce false positives or silence smoke alarms when there is no danger of fire.

SUMMARY OF THE INVENTION

In view of the foregoing, it is an object of the present invention to provide a smoke deflector and related methods. In one embodiment, a smoke deflector comprises a pole, a handle on a first end of the pole, and a fan assembly mounted on a second end of the pole opposite the handle.

In another embodiment, a method for using a smoke deflector to blow smoke away from a smoke detector comprises the steps of holding the smoke deflector by the handle, adjusting the pole of the smoke deflector to set a desired length, adjusting the fan assembly of the smoke deflector to a desired angle, positioning the fan assembly adjacent to the smoke detector, and turning on the smoke deflector.

These and other objects, aspects and advantages of the present invention will be better understood in view of the drawing and following detailed description of preferred embodiments.

DETAILED DESCRIPTION OF PREFERRED EMBODIMENTS

Figure 1:
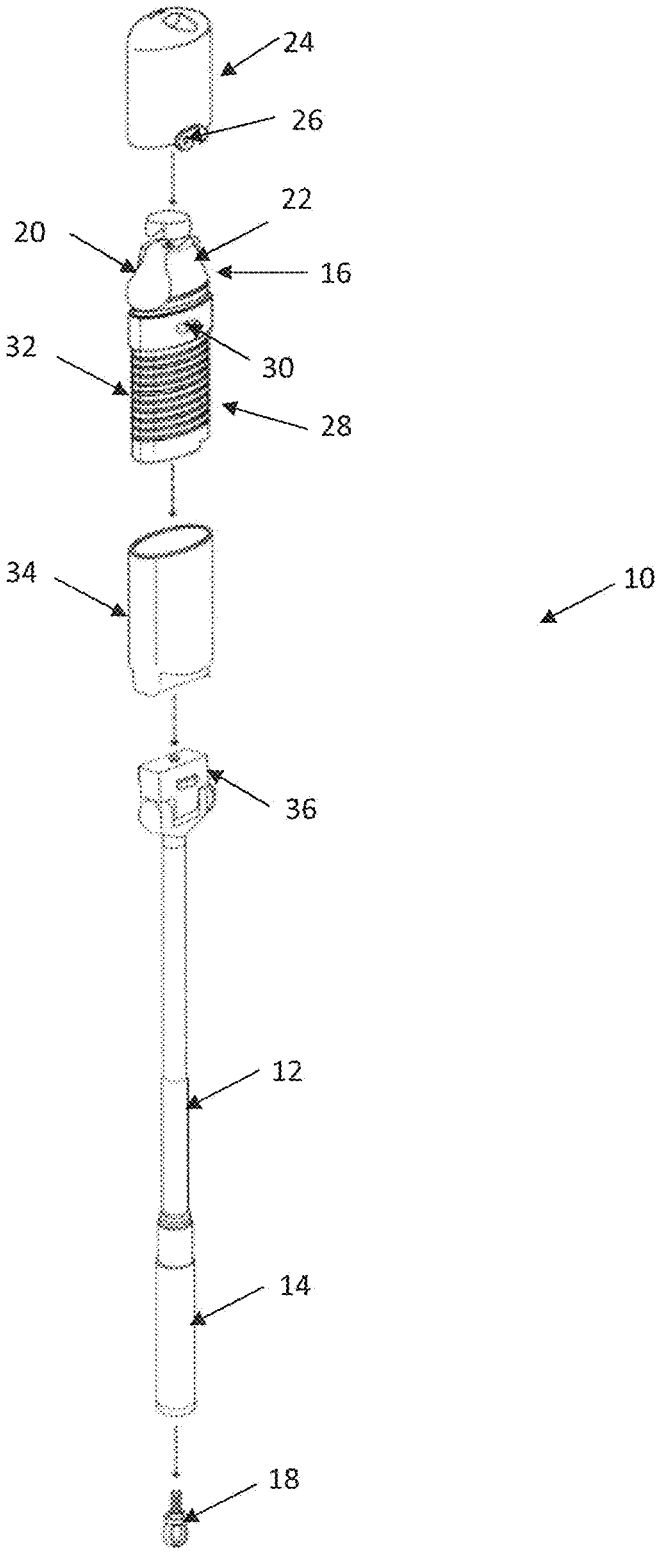
FIG. 1 is an expanded front view of a smoke deflector, according to an embodiment of the presented invention.

According to an embodiment of the present invention and referring to FIG. 1, a smoke deflector 10 includes a pole 12, a handle 14 on a first end of the pole, and a fan assembly 16 mounted on a second end of the pole 12 opposite the handle 14. The pole 12 can be used to position the fan assembly 16 proximate to a smoke detector and thus deflect smoke away from the detector.

It is preferred that the pole 12 will be an elongated pipe or tube of circular cross-section. The pole 12 will advantageously include telescoping sections, allowing the smoke deflector 10 to direct smoke away from smoke detectors that are mounted higher. The telescoping sections can be nested one within another and made into compact units. The smoke deflector 10 is stored when the pole 12 is in a stowed position, and it is in use when the pole 12 is extended to a desired length. It is preferred that the pole 12 be made of metal, but any sufficiently durable material will be useful.

The handle 14, which is on the first end of the pole 12, can be made out of any material that will provide durability and a strong grip to the user, for example, rubber. In the depicted embodiment, the handle 14 is connected to a hanging hook 18.

Figure 2:
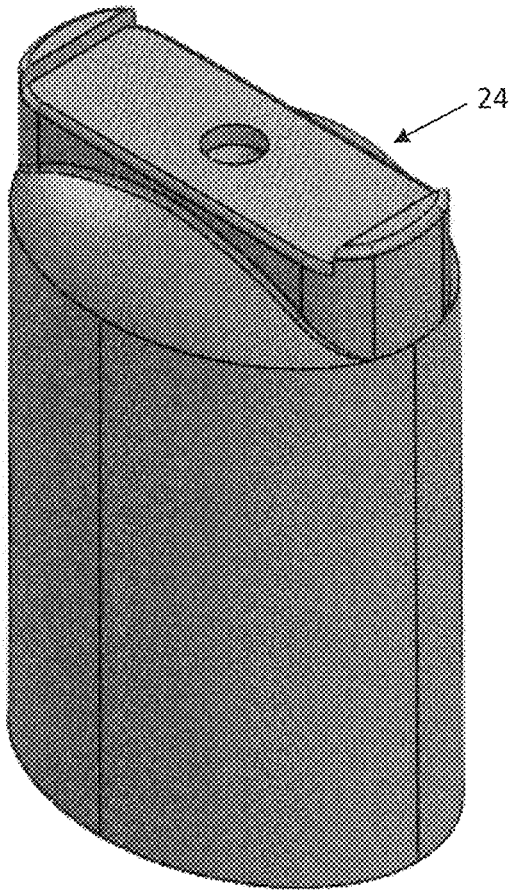
FIG. 2 is a perspective view of the fan cover for the smoke deflector of FIG. 1.

The fan assembly 16 includes a ducted fan 20, a fan motor 22, and an optional fan cover 24. The ducted fan 20 is a propulsion arrangement whereby a mechanical fan or a propeller is mounted on a motor 22. The blades of the fan 20 are collapsible from an extended working position to a folded position, as shown in FIG. 1. In one embodiment, the fan assembly 16 is pivotally mounted on an axis that is perpendicular to the axis of the pole 12 such that the fan assembly 16 can be pointed toward and/or adjacent to a smoke detector. The fan assembly 16 swings about 180 degrees relative to the axis that is perpendicular to the axis of the pole 12. FIG. 2 illustrates an example of the fan cover 24. However, the fan cover 24 can employ other forms and/or shapes. The fan cover 24 can also have a locking piece 26 to secure the fan cover 24 on top of the ducted fan 20 and the fan motor 22.

In the depicted embodiment, the fan assembly 16 is connected to a power module 28, which comprises a fan power switch 30 and a battery housing 34 for one or more batteries 32. The fan motor 22 is wired to the power module 28 by a cable (not shown). The battery housing 34 is attached to a mounting member 36, which is pivotally mounted about an axis that is perpendicular to an axis of the pole and configured to be adjustable about 90 degrees in two directions in perpendicular to the axis of the pole 12. The fan assembly 16 and the power module 28 can thus swing 90 degrees in two directions. A user can adjust the angle of the fan assembly 16 to be proximate to a smoke detector and to deflect smoke away.

In an alternative embodiment, the power module 26, or at least the fan power switch 28, is configured to be located proximate the handle, allowing a user conveniently to control electrical power to the fan assembly 16 while holding the smoke deflector 10 with just one hand.

Figure 3:
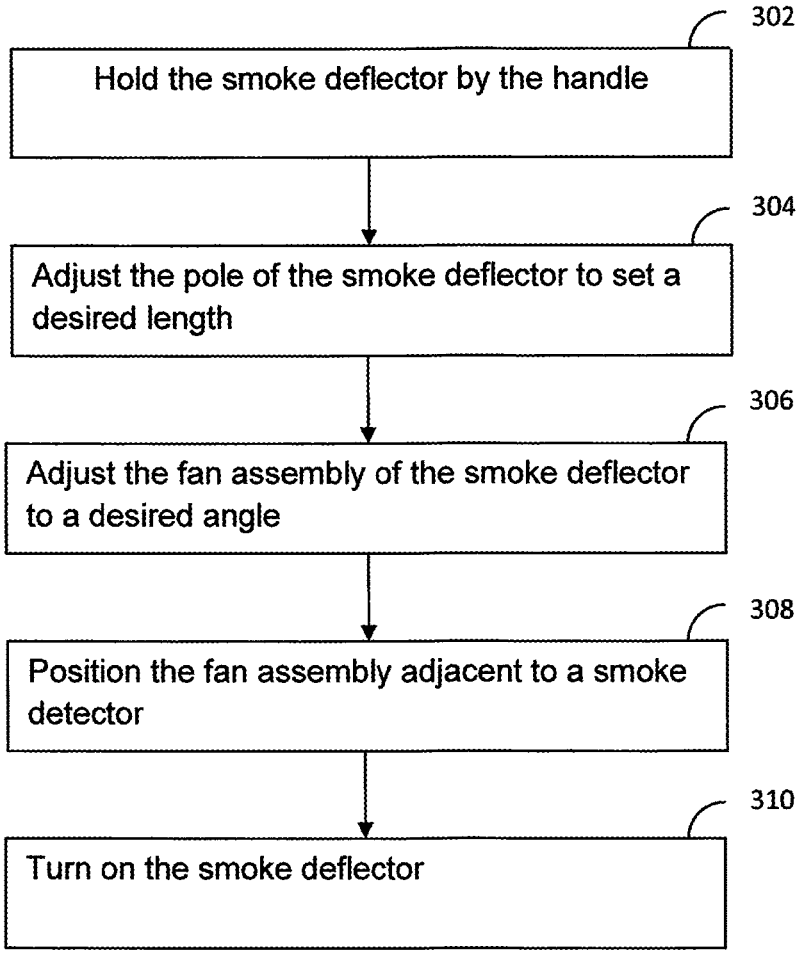
FIG. 3 is a flow chart illustrating an example method of using the smoke deflector of FIG. 1.

In use, referring to FIG. 3, at step 302, a user holds the smoke deflector 10 by the handle 14. At step 304, telescoping pole 12 of the smoke deflector 10 is adjusted to set a desired length. At step 306, the fan assembly 16 of the smoke deflector 10 is adjusted to a desired angle. Once the user has set the desired length and angle, the user positions the fan assembly 16 adjacent to the smoke detector at step 308 and turns on the smoke reflector 10 (e.g., turns on the fan switch 30) at step 310. The fan 20 blows smoke away from the smoke detector 10, preventing or stopping an unwanted alarm.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

What is claimed is:

1. A method of using a smoke deflector to blow smoke away from a smoke detector, wherein the smoke deflector comprises a pole, a handle on a first end of the pole, and a fan assembly and a power module mounted on a second end of the pole opposite the handle, and wherein the power module and the fan assembly are pivotally mounted on an axis that is perpendicular to an axis of the pole and configured to be adjustable 90 degrees in two directions about the axis that is perpendicular to the axis of the pole, the method comprising the steps of:

holding the smoke deflector by the handle;

adjusting the pole of the smoke deflector to set a desired length;

adjusting the fan assembly of the smoke deflector to a desired angle, wherein the desired angle is 90 degrees in the two directions about the axis that is perpendicular to the axis of the pole;

positioning the fan assembly adjacent to the smoke detector; and turning on the smoke deflector.

2. The method of claim 1, wherein the power module includes one or more batteries installed inside a battery housing.

3. The method of claim 1, wherein the pole includes telescoping sections.

* * * * *